United States Patent [19]

Shoff

[11] Patent Number: 4,508,014

[45] Date of Patent: Apr. 2, 1985

[54] REMOTE CONTROL APPARATUS FOR A MACHINE SUCH AS A CRANE

[75] Inventor: Bernell D. Shoff, Windsor, Pa.

[73] Assignee: U.S. Truck Cranes, Inc., York, Pa.

[21] Appl. No.: 386,270

[22] Filed: Jun. 8, 1982

[51] Int. Cl.[3] ..... F15B 13/08

[52] U.S. Cl. ..... 91/527; 137/596.12; 137/596.17; 200/81 H; 200/81.4; 212/160

[58] Field of Search ..... 91/527; 137/596.12, 137/596.17; 200/81 H, 81.4, 83 Q, 83 T, DIG. 5; 212/160

[56] References Cited

U.S. PATENT DOCUMENTS

| | | | |
|---|---|---|---|
| 2,254,083 | 8/1941 | Nickles | 212/38 |
| 2,440,943 | 5/1948 | Gonsett et al. | 200/172 |
| 2,523,120 | 9/1950 | Kenyon | 318/45 |
| 2,795,144 | 6/1957 | Morse | 74/17.8 |
| 3,173,550 | 3/1965 | Province | 212/35 |
| 3,316,379 | 4/1967 | Clarke et al. | 200/168 |
| 3,471,158 | 10/1969 | Solins | 277/32 |
| 3,554,204 | 1/1971 | Bellman | 137/81.5 |
| 3,554,214 | 1/1971 | Stenlund | 137/270 |
| 3,588,395 | 6/1971 | Hersey | 200/83 |
| 3,596,670 | 8/1971 | Fehr | 137/81.5 |
| 3,623,053 | 11/1971 | Meyer | 340/242 |
| 3,665,947 | 5/1972 | Mayer | 137/81.5 |
| 3,845,258 | 10/1974 | Bruels | 200/81 H |
| 3,904,842 | 9/1975 | Gauer | 200/81 R |
| 4,016,903 | 4/1977 | Akashi et al. | 137/493.5 |
| 4,091,249 | 5/1978 | Huffman | 200/83 P |
| 4,133,346 | 1/1979 | Smith et al. | 137/493.6 |
| 4,149,567 | 4/1979 | Weirich | 138/111 |
| 4,150,264 | 4/1979 | Lieberman | 200/51 LM |
| 4,229,629 | 10/1980 | Pawlowski | 200/82 R |
| 4,243,858 | 1/1981 | Place | 200/83 P |
| 4,306,314 | 12/1981 | Griffiths | 251/131 X |
| 4,307,810 | 12/1981 | Spalluto | 212/160 |

FOREIGN PATENT DOCUMENTS

| | | | |
|---|---|---|---|
| 2492040 | 4/1982 | France | 137/625.64 |

*Primary Examiner*—Gerald A. Michalsky

*Attorney, Agent, or Firm*—Gottlieb, Rackman & Reisman

[57] ABSTRACT

Disclosed is control apparatus for a machine such as crane which includes a remote control assembly fluid-coupled to the machine by a substantially electrically non-conducting tube assembly. The machine can be operated remotely from the remote control assembly or from an electrical control assembly disposed at the machine. Apparatus is provided for automatically shutting down all or selected machine functions in response to a blockage in one or more of the fluid lines extending between the remote control apparatus and the machine. In a preferred embodiment, the remote control assembly includes pneumatic switches coupled by the fluid lines to electric pressure switches disposed at the machine. The pressure switches are in turn coupled to electro-mechanical devices for controlling the machine functions. The apparatus for shutting down one or more machine functions comprises one or more pneumatic valves connected to the inlet of one or more respective pressure switches which causes the respective pressure switch to change state in response to said blockage and thereby shut down one or more machine functions.

8 Claims, 11 Drawing Figures

49
51
75
Terminal Block
26
20
Power
On
21
Hoist
Up
On
22
Trolley
In
Out
23
Swing
Rt
Lt
24
Boom
Up
Dn
25
Emergency Stop 26
Power
20
Off
On
Hoist
21
Up
Dn
Trolley
22
In
Out
Swing
23
Right
Left
Boom
24
Up
Down
Emergency
25
Power
Stop

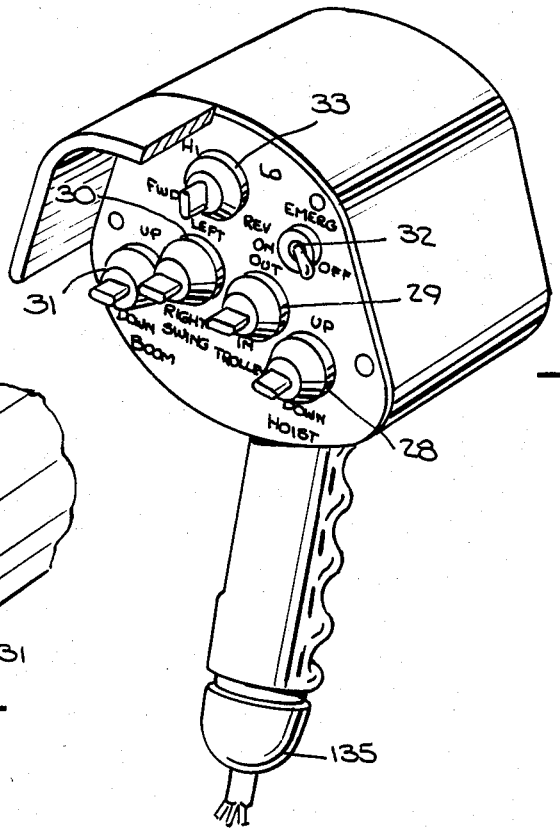
Fig. 6.
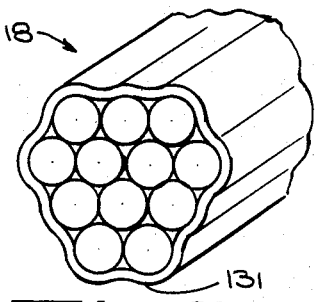
Fig. 11.
Fig. 7.
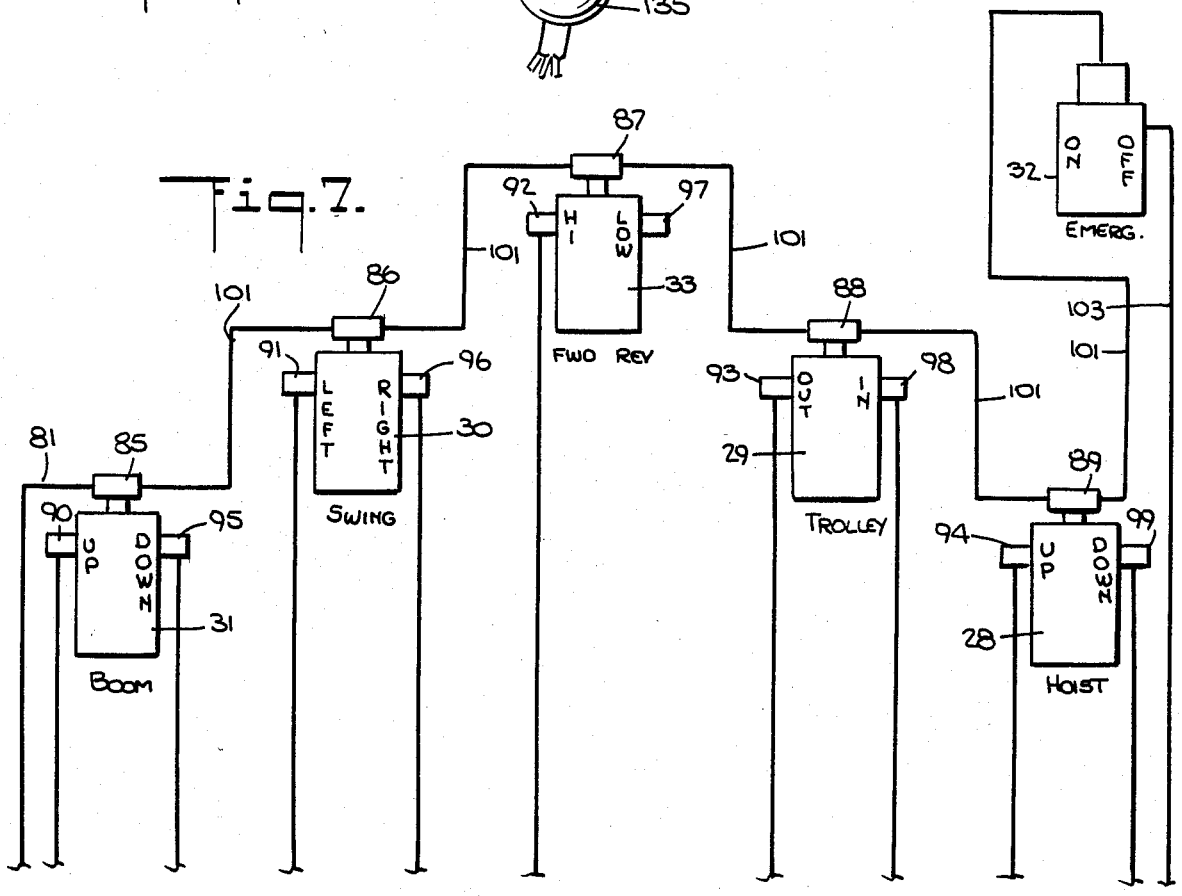

REMOTE CONTROL APPARATUS FOR A MACHINE SUCH AS A CRANE

BACKGROUND OF THE INVENTION

The present invention relates to a remote control apparatus, particularly a pneumatic remote control apparatus, for operating and controlling a machine such as a crane from a variable location spaced from the machine.

It is often necessary for an operator when operating a crane from its cab or from a control box secured to the cab or a truck on which the crane is mounted to be directed by a person having a better view of the work area in which the crane is operating and of the load being lifted and/or moved by the crane. Remote control apparatus are known for operating various crane functions such as movement of the hoist, trolley, boom and swing. However, such remote control apparatus suffered from the disadvantage that it was connected to the crane by electrically conductive structure so as to expose the crane operator to the hazards of electrical shock should the crane strike electrical wires or other sources of current. U.S. Pat. No. 4,307,810, issued Dec. 29, 1981, discloses as a solution to this problem a remote control apparatus including pneumatic switches which is coupled to the crane by plastic tubing so as to electrically insulate the pneumatic switches from the crane, thereby avoiding the disposition of a highly conductive electrical path between the crane and the pneumatic switches.

The remote control apparatus in the '810 patent has the drawback however that a relatively long assemblage of tubing for carrying pressurized air between the pneumatic switches and the crane typically lies along the ground at the work site where it is subject to pinching and crimping. Such pinching and/or crimping can under certain circumstances result in a loss of control over the various crane functions from the remote control apparatus, thereby causing an unpredictable and possibly uncontrollable operation of the crane.

The invention disclosed herein eliminates the aforementioned drawback and enables all crane functions to be shut down automatically should a loss of control occur while operating the crane from the remote control apparatus.

OBJECTS AND SUMMARY OF THE INVENTION

It is an object of the present invention to provide apparatus for controlling a machine through a fluid coupling of the apparatus to the machine in which one or more machine functions are automatically disabled in response to a blockage in the fluid coupling.

It is another object of the present invention to provide apparatus for controlling a machine from a remote location through a fluid coupling of the apparatus and the machine in which one or more machine functions are automatically disabled in response to a blockage in the fluid coupling.

It is another object of the present invention to provide a remote control apparatus pneumatically coupled to a machine for controlling machine functions at a remote location which disables machine functions automatically upon blockage of one or more of the pneumatic lines coupling the remote control apparatus to the machine.

It is a further object of the present invention to provide such a pneumatically coupled remote control apparatus with a time delay between a blockage of one or more of the pneumatic lines and disabling of machine functions so that insignificant and/or temporary blockages of one or more pneumatic lines caused for example by movement of the remote control apparatus by the operator from place to place will not unnecessarily disable operation of the machine.

The above and other objects of the invention are achieved and the aforementioned drawback is eliminated by automatically sensing a fluid blockage in a fluid coupling between a control apparatus and a machine being controlled and in response thereto automatically ceasing or disabling the operation of at least one machine function.

The control apparatus is fluidly coupled to pressure switches having electrical contacts connected in the machine electrical control system. The switches open and close their electrical contacts in response to fluid pressure at the inlet of the respective switch. In response to a blockage of fluid pressure to one or more of the pressure switches, pressure is automatically reduced at the inlet of the respective switch to enable it to change its state. Where the particular pressure switch is connected in the machine control system so as to disable all machine functions in response to a blockage, a time delay is introduced between the occurrence of a blockage and the switching of that pressure switch.

The invention is described in more detail below in connection with a pneumatic control apparatus pneumatically coupled to the machine, although the invention is applicable to other fluid couplings of the control apparatus and the machine.

In the preferred embodiment, pneumatic switches are disposed in a remote control apparatus and are pneumatically coupled by pneumatic lines to pneumatic-to-electric pressure switches having their electrical contacts connected in the machine electrical control system. The pressure switches thereby couple the remote control apparatus to the machine electrical control system. The pressure switch electrical contacts are closed or opened in response to the presence or absence of a predetermined pressure level at the inlet of the respective pressure switch. Means are provided to allow air pressure to relatively slowly bleed from the inlet of at least one pressure switch in response to a substantial blockage of air pressure in one or more of said pneumatic lines. The bleeding of air pressure in response to a blockage causes at least one pressure switch to change state which in turn causes one or more machine functions to cease or be disabled. The pressure switches are electrically connected to apparatus which controls machine functions and the one pressure switch is coupled to apparatus which can cease or disable at least one and preferably all of the machine functions. The one pneumatic pressure switch thereby automatically changes state in response to a substantial blockage of one or more of the pneumatic lines coupling the remote control assembly and the pneumatic pressure switches a predetermined time after the occurrence of the blockage.

Additionally, in accordance with the preferred embodiment, the remote control apparatus includes an emergency pneumatic switch which is coupled to the one pneumatic pressure switch by a pneumatic line, and pneumatic function switches coupled to other pressure switches by pneumatic lines. Each pneumatic function switch enables the operator to control a specific machine function and the emergency pneumatic switch ordinarily allows the operator to shut down the machine in the event of an emergency or should control be lost of one or more of the individual machine functions. It is possible that control of the one pneumatic pressure switch by the emergency pneumatic switch can be lost when a pneumatic line between the remote control apparatus and the pressure switches becomes blocked. The invention causes the pneumatic pressure switch to change state as described above in response to a substantial blockage of a pneumatic line supplying air pressure to the one pressure switch after a predetermined time has elapsed. That pressure switch in turn is operative to cease or disable one or more machine functions in response to a change of state thereof.

The means for bleeding pressure can comprise a shuttle valve connected between the pneumatic line from the emergency pneumatic switch in the remote control apparatus and the inlet of the one pneumatic pressure switch. The shuttle valve operates to slowly bleed air pressure at the inlet of the one pneumatic pressure switch when the pneumatic line supplying air pressure to the one pneumatic pressure switch is substantially blocked. The shuttle valve comprises a pneumatic pressure inlet port, a pneumatic pressure outlet port, and an exhaust port. The exhaust port and the outlet port are communicated when the pressure at the inlet port falls below a predetermined level, as when a pneumatic line supplying air pressure to the shuttle valve becomes blocked. The exhaust port of the valve has a relatively small opening whose size is selected so that air pressure within the valve bleeds off relatively slowly, thereby introducing the aforementioned time delay. The purpose for this is not to change the state of the one pressure switch in response to momentary or insubstantial blockages of a pneumatic line supplying the valve.

Each of the remaining pressure switches is coupled to a corresponding pneumatic function switch in the remote control apparatus by a pneumatic line through a quick exhaust shuttle valve similar to the shuttle valve discussed above. The quick exhaust shuttle valves have a relatively large exhaust port opening so as to quickly cause the valve to communicate the outlet and exhaust ports in response to a reduction of the pressure at the inlet port. Since each of the remaining pneumatic pressure switches controls a single machine function, should that function be momentarily interrupted because of either an insubstantial blockage or a temporary blockage, the entire machine would not shut down.

The invention is particularly useful in the control of a hydraulically-actuated crane. The control system for such a crane includes an electrical switch panel assembly in which individual function switches are electrically coupled in the electrical control system to complete the electrical circuit between a source of power and the coil of a solenoid hydraulic control valve. The electrical switch panel assembly also includes an emergency electrical switch coupled to complete the circuit between the coil of an emergency hydraulic dump valve connected in the main hydraulic line to the hydraulic function valves. Thus, each crane function and an emergency shut down of all crane functions can be carried out at the electrical switch panel assembly. The remote control apparatus includes a remote control panel assembly coupled to the pneumatic pressure switches described above via a tube assembly and the shuttle valves discussed above. The electrical contacts of the pneumatic pressure switches are connected in parallel with the electrical contacts of the switches in the electrical switch panel assembly so that a respective crane function can be controlled either at the electrical switch panel assembly or at the pneumatic control panel assembly. The tube assembly coupling the pneumatic control panel assembly to the pneumatic pressure switches is made of a substantially electrically non-conducting material such as plastic. Since the emergency pneumatic switch operates via the shuttle valve described above having an exhaust port of relatively small size, momentary or insubstantial blockages of the pneumatic line to that shuttle valve will not shut down all crane functions.

It is another object of the present invention to provide an improved tube assembly for pneumatically coupling the aforementioned remote control apparatus to the machine.

This object is achieved by tightly bunching individual pneumatic tubes of the assembly together by means of heat shrinkable tubing (shrink tubing). The shrink tubing draws the tubes into a tightly bunched assembly which increases the mechanical strength of the assembly. The shrink tubing also conforms to the configuration of the bunched tubes even if the tubes are not aligned into a substantially tubular configuration. Thus, the shrink tubing eliminates any voids between individual tubes and between the tubes and the shrink tubing, thereby avoiding the possibility that such voids could become current carrying paths if conductive matter should get into the voids.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIG. 3 is a front view of the electrical control panel assembly mounted at the crane, depicting the electric toggle switches which control the crane's hydraulic function valves;

FIG. 6 is a perspective view of the pneumatic control panel assembly depicting the pneumatic toggle switches which can control the crane's hydraulic function valves in parallel with the electric toggle switches;

FIG. 7 is a schematic diagram depicting the pneumatic connection of the pneumatic toggle switches of the pneumatic control panel assembly of FIG. 6;

FIG. 11 is a perspective view, partly broken away, of the pneumatic tube assembly connecting the pneumatic control panel assembly of FIG. 6 to the converter assembly of FIG. 5.

DESCRIPTION OF THE PREFERRED EMBODIMENT

Figure 1:
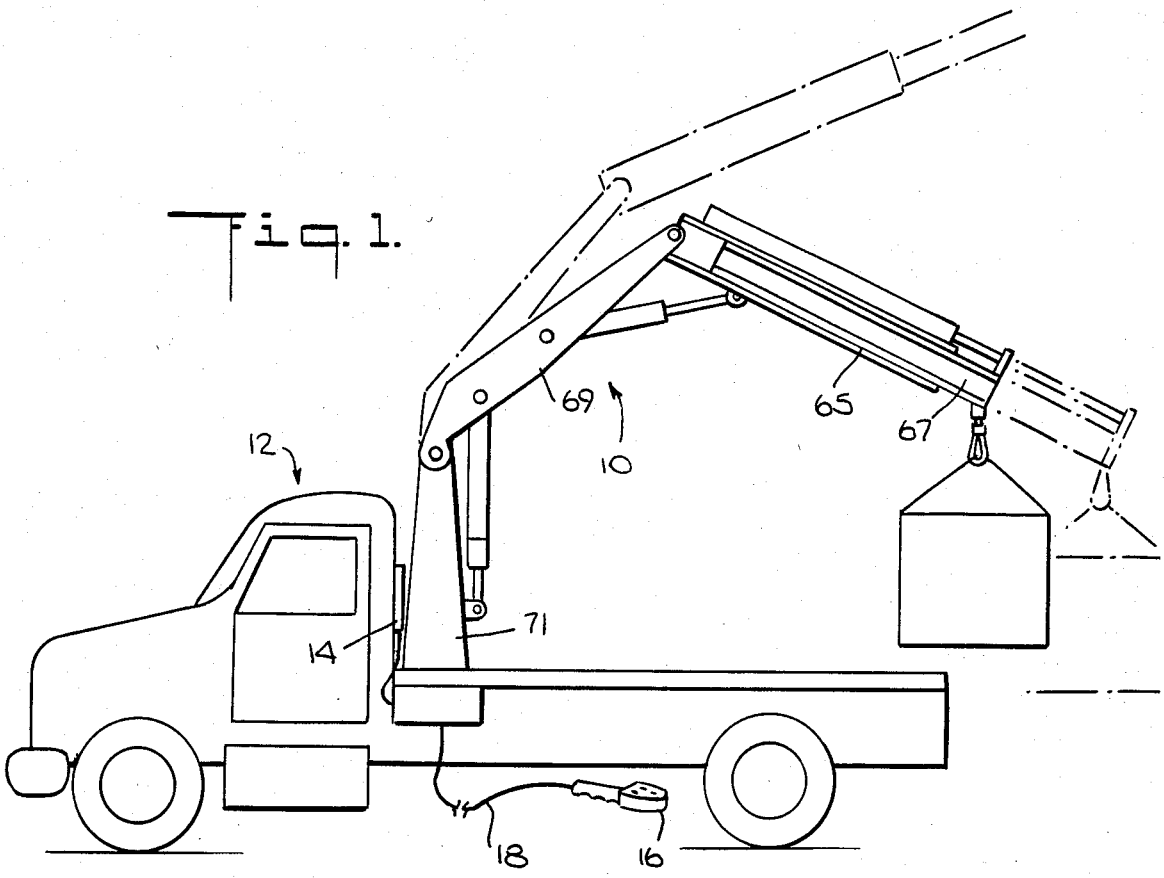
FIG. 1 is a side generally schematic view of a truck-mounted, hydraulically-actuated, articulating crane remotely operable by means of a pneumatic control panel assembly connected to the crane control system by an essentially electrically non-conducting pneumatic tube assembly.

A preferred embodiment of the invention is illustrated in the drawings and described below in connection with a truck-mounted, articulating, hydraulically-actuated crane. However, the invention can be used with other types of cranes and other types of machines and equipment.

As illustrated in FIG. 1, the articulating, hydraulically-actuated crane 10 is mounted on a truck 12 and can be operated at the truck from an electrical control panel assembly 14 mounted to the truck or remotely from the truck from a pneumatic remote control panel assembly 16 connected to the crane control system by an essentially electrically nonconducting pneumatic tube assembly 18. The pneumatic control panel assembly 16 is of a convenient size and shape so as to enable the control panel to be held by one hand of the operator at a convenient location and at a convenient distance from the crane. Since the pneumatic control panel assembly is essentially insulated from the crane and truck, the crane operator, when operating the crane from the pneumatic control panel assembly, is protected from electrical shock should the crane come into contact with electrical wires.

The electrical control panel assembly 14 forms part of the electrical control system for the crane and includes a bank of electrical toggle switches 20–25 (FIGS. 2 and 3) for operating electrically-controlled hydraulic valves (not shown) which control various crane functions. The electrical control panel assembly also includes a pilot light 26 which is illuminated when electrical power is supplied to the crane control system.

Pneumatic control panel assembly 16 includes a bank of pneumatic toggle switches 28–33 (FIGS. 2 and 6) pneumatically coupled to the crane electrical control system by the tube assembly 18. The electrical toggle switches 21–25 and the pneumatic toggle switches 28–32, respectively, are functionally connected in parallel. Thus, respective crane functions can be controlled at the truck electrically from the electrical control panel assembly 14 or electro-pneumatically from the pneumatic control panel assembly 16. Additionally, the pneumatic toggle switch 33 is coupled to a throttle valve for remotely controlling the truck's throttle from the pneumatic control panel assembly.

For the hydraulic crane depicted in FIG. 1, electrical toggle switches 21–24 (electrical control panel assembly 14 in FIG. 4) are three position switches which control via the respective hydraulic valve the crane hoist 65, trolley 67, boom 69 and the swing of the crane base 71, respectively, through respective rams. Electrical toggle switch 20 is a two position on/off power switch and electrical toggle switch 25 is a two position emergency stop switch. Each three position switch 21–24 has a central inactive position and two active positions. For example, the active positions for the hoist switch 21 are left for hoist "down" and right for hoist "up". The two position emergency switch 25 has two active positions, "operate" (right) and "stop" (left), and controls a solenoid which in turn controls an emergency dump valve (not shown) in the main hydraulic pressure line (not shown) to the different hydraulic function valves. In the "stop" position of the emergency switch 25, its contacts are opened thereby interrupting current to the solenoid of the emergency dump valve and closing the hydraulic dump valve to cut off the supply of hydraulic pressure to the hydraulic function valves. The two position on/-off power switch 20 controls the supply of electrical power from the battery to the crane electrical control system. As mentioned, the electrical control panel assembly 14 is attached to the truck or crane and its switches may be used by the operator to control the aforementioned crane functions as he stands adjacent the position in which the control panel is secured to the truck.

The pneumatic function toggle switches 28–31 (pneumatic control panel assembly 16 in FIG. 6) are three position toggle switches corresponding to the three-position electrical function toggle switches 21–24; the pneumatic emergency toggle switch 32 is a two position toggle switch corresponding to the two-position electrical emergency toggle switch 25; and the pneumatic toggle switch 33 (throttle control) is a three position toggle switch having no counterpart on the electrical control panel assembly.

Figure 2:
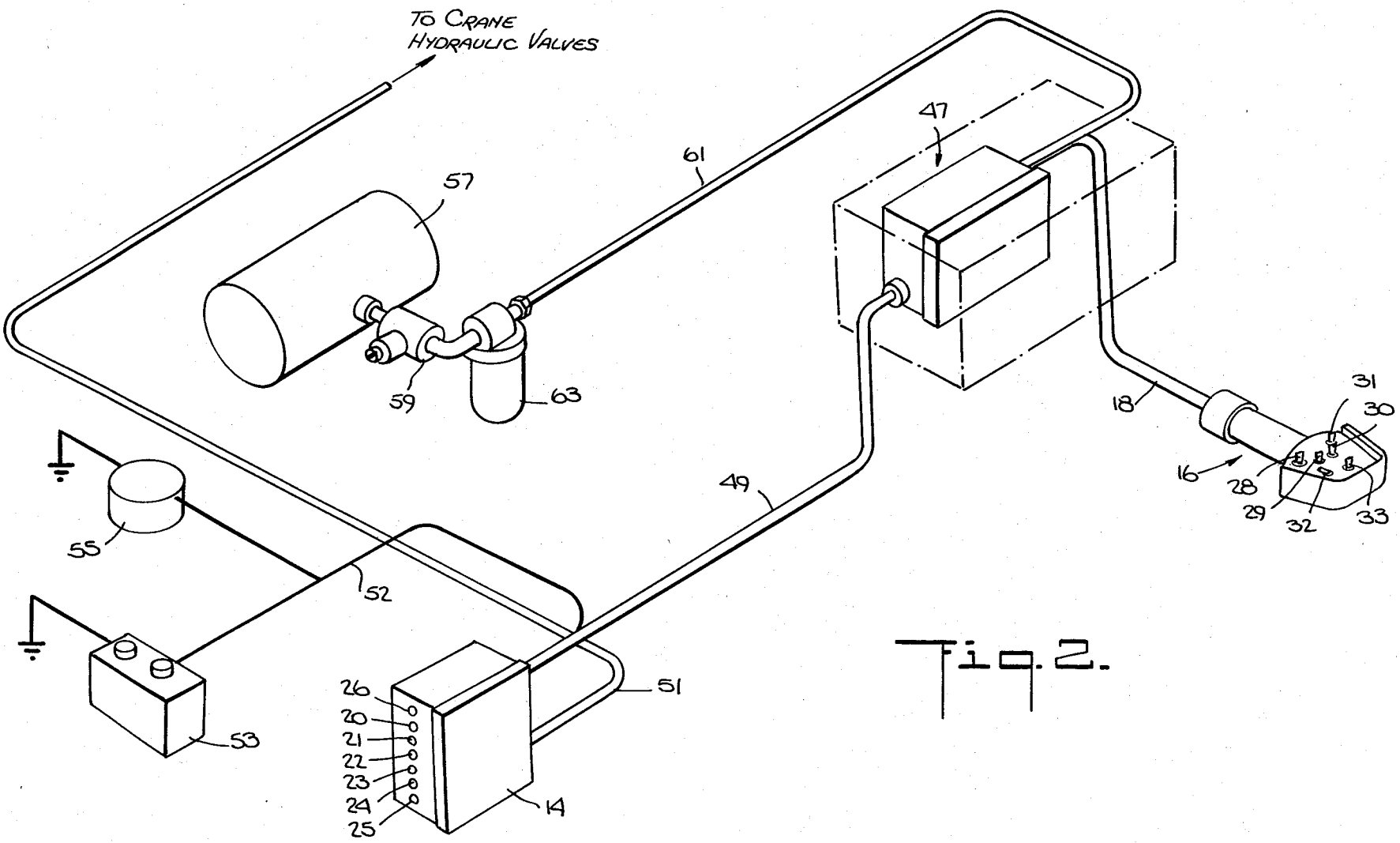
FIG. 2 is a schematic diagram of the electrical and electro-pneumatic control system for controlling the crane's hydraulic function valves.

Referring to FIG. 2, the pneumatic toggle switches 28–33 are connected by respective pneumatic tubes in the tube assembly 18 to pneumatic pressure switches 36–45 (FIG. 5) in a pneumatic-to-electric converter assembly 47. An electric cable assembly 49 connects the electrical outputs of the pneumatic pressure switches 36–45 in parallel with the outputs of respective electrical toggle switches 21–25. An electrical cable assembly 51 couples a respective electrical and pneumatic pressure switch output with a respective hydraulic valve. Another cable assembly 52 connects a battery 53 to the control system for the crane and further connects a solenoid valve 55 for controlling the throttle of the truck's engine to a pneumatic pressure switch (not shown) which is coupled to the throttle control pneumatic switch 33 of the remote control assembly.

The pneumatic portion of the crane control system also includes a tank 57 (FIG. 2) suitable for containing pressurized air introduced into the tank from a compressor (not shown) mounted on the truck through a control valve 59. The control valve 59 also connects the tank to a pneumatic line 61 feeding the pneumatic control panel assembly 16 through the converter assembly 47. In one position of the valve 59, the tank 57 is communicated with the compressor and in another position, the tank is communicated with the pneumatic line 61. The control valve is of the type which suppresses air flow from the tank to the pneumatic line 61 until the air pressure in the tank is greater than a predetermined minimum value necessary to insure that the pneumatic pressure switches 36–45 can be safely operated. A filter 63 is connected to the pneumatic line 61 to remove water and particulate matter which could obstruct small passages in the pneumatic lines and components.

Figure 4:
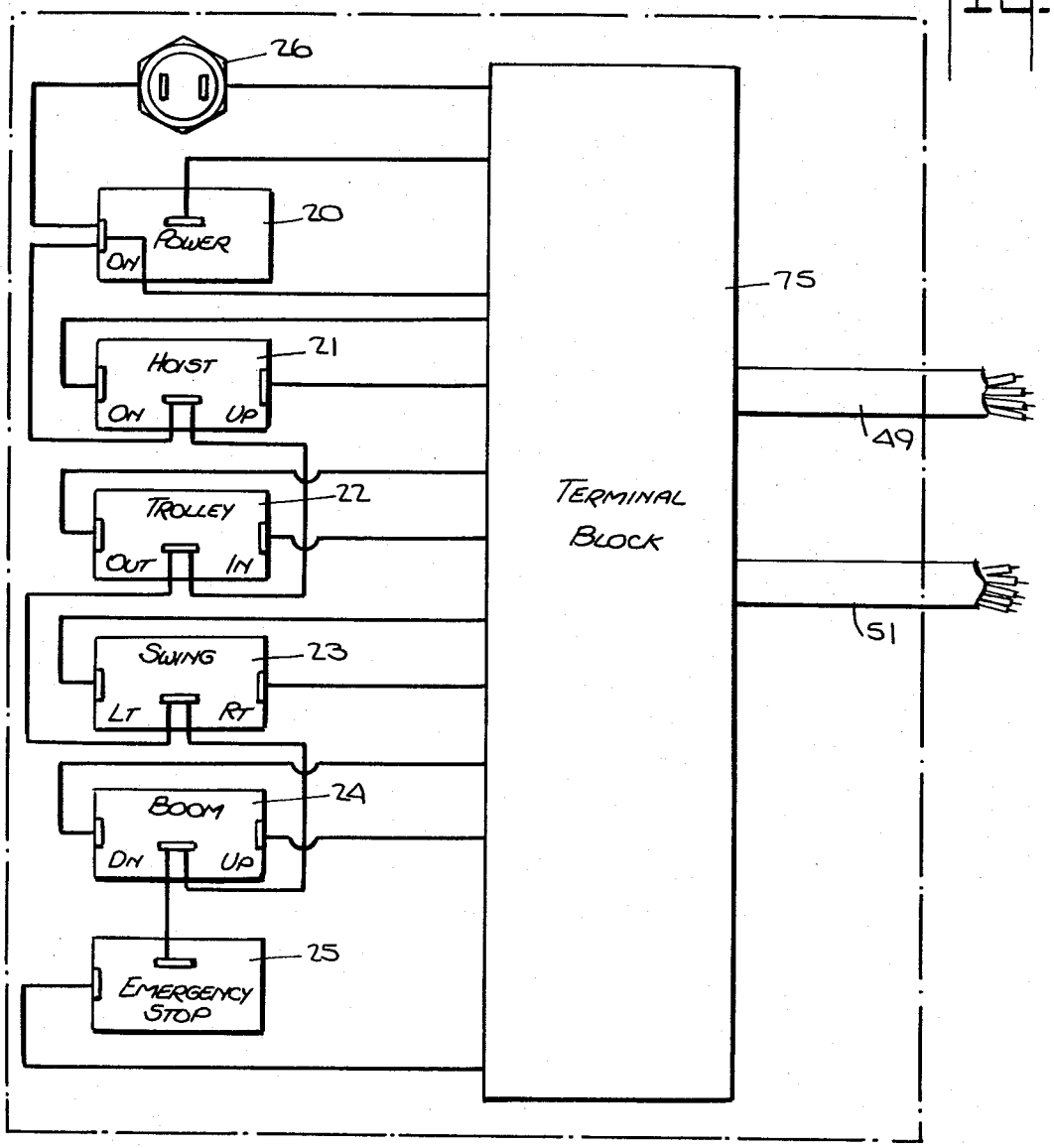
FIG. 4 is a schematic diagram showing the electrical connection of the electric toggle switches of the electrical control panel assembly of FIG. 3.
Figure 1:
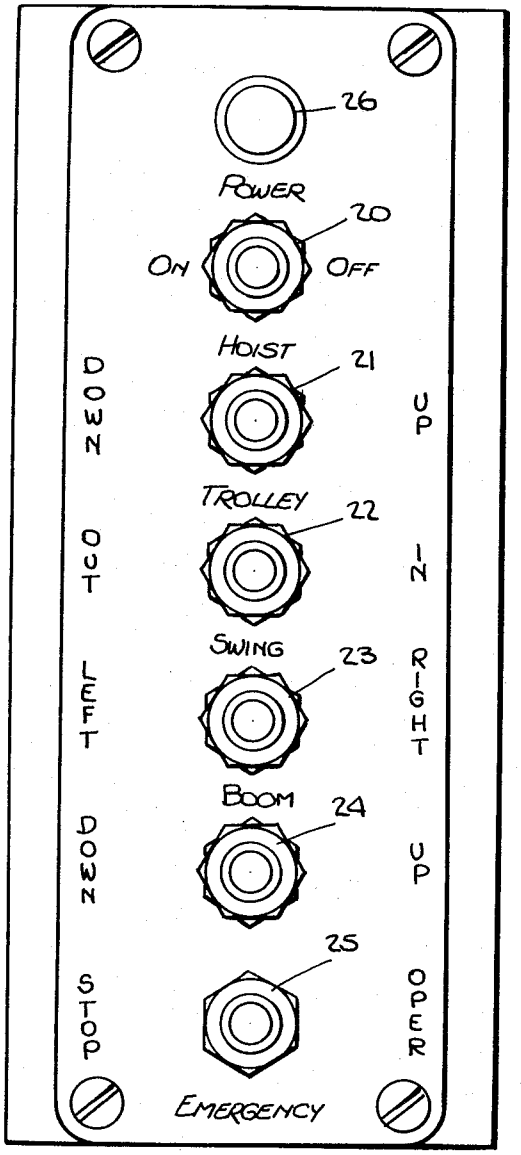

Referring to FIGS. 2–4, the electrical cable assembly 51 from the electrical control panel assembly 14 includes a plurality of electrical wires coupling respective switch contacts of the electrical toggle switches 21–24 with the coils of respective hydraulic valves through an electrical terminal block 75 (FIG. 4). Closing the switch contacts of a respective electrical switch completes a current path from the battery through a respective coil to energize the coil, except in the case of the emergency dump valve, where the switch contacts are opened to de-energize the coil. Thus, one of the contacts of each switch is connected to the battery. The electrical cable assembly 49 from the converter assembly 47 includes a plurality of electrical wires connected to the terminal block 75 so as to connect the electrical outputs of respective pneumatic pressure switches 37–45 in parallel with respective electrical switches 21–25 and pneumatic pressure switch 36 to the coil of the throttle valve 55. The pneumatic pressure switches are in turn coupled to respective outputs of the respective pneumatic switches 28–33 of the pneumatic control panel assembly 16 via tube assembly 18 so as to functionally connect respective pneumatic and electrical switches in parallel and pneumatic switch 33 to the throttle valve.

The two position electrical emergency switch 25 is connected so that its switch elements are in parallel with the contacts of the normally closed pressure switch 45. Air pressure is thereby required to open the contacts of pressure switch 45 and prevent current from being supplied to the emergency dump valve. Thus, whenever the crane is to operate, pneumatic pressure switch 45 must be receiving pressure to maintain its contacts open. In this manner, the solenoid of the emergency dump valve can be controlled by the operator at pneumatic control panel assembly 16 as well as at the electrical control panel 14.

The various pneumatic pressure switches, pneumatic toggle switches, electrical toggle switches, solenoids, dump valve and hydraulic function valves may be of conventional structure consistent with the current and pressure ranges to be anticipated.

Figure 5:
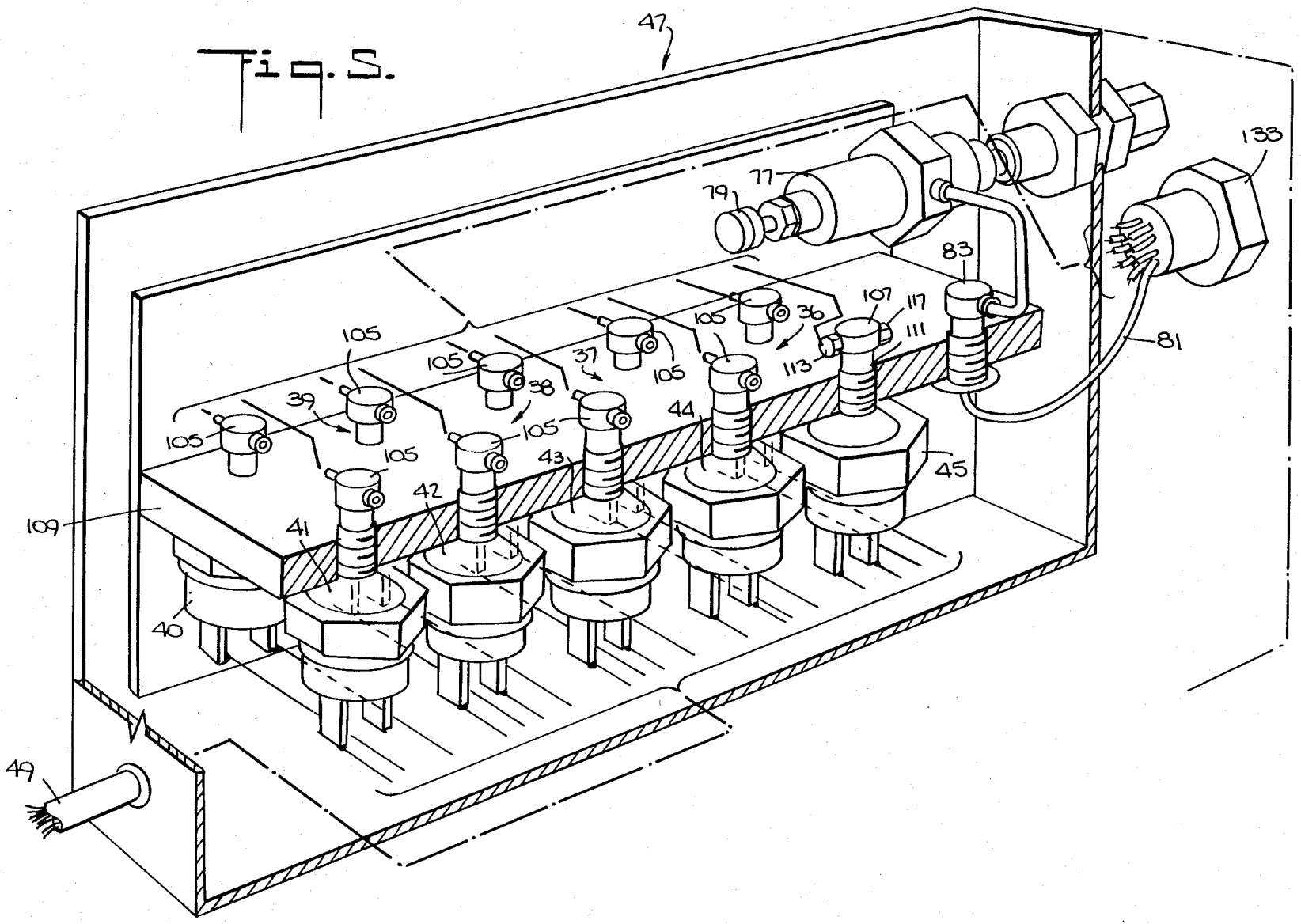
FIG. 5 is a perspective view, partly broken away and partly in section, of the pneumatic-to-electric converter assembly which is connected between the pneumatic control panel assembly and the crane electrical control panel assembly.

Referring to FIG. 5, the pneumatic-to-electric convertor assembly 47 includes the pneumatic pressure switches 36–44, which have normally open electrical contacts, and pneumatic pressure switch 45 which has normally closed electrical contacts, as mentioned. The converter assembly also includes a regulator 77 which receives pressurized air from the tank 57 via pneumatic line 61. The function of the regulator 77 is to regulate or stablize the air pressure from line 61 before the air pressure is supplied to the pneumatic toggle switches. Such regulator apparatus is well known in the art and therefore will not be described further. The regulator has an adjusting screw 79 at which readings may be taken of the regulated air pressure to permit adjustment thereof, if necesary. The regulated air pressure is conducted to the pneumatic control panel assembly by a main tube 81 carried within the tube assembly 18. A coupling 83 is provided in the converter assembly to couple the regulator 77 to the main tube 81. The tube 81 is made of an essentially non-electrically conducting material such as plastic, for example vinyl.

Referring to FIGS. 6 and 7, the pneumatic toggle switches are connected at the pneumatic control panel assembly 16 in sequence to receive the pressurized air carried by the main tube 81. Each switch 28–31 and 33 is a three position toggle switch which can be of the conventional shuttle type wherein operator manipulation of the respective switch toggle translates a cylinder having a hole therein to one of three positions, thereby directing the air entering the valve via an inlet 85–89 to one of two outlets 90–94 and 95–99, respectively, while blocking the other outlet, or directing the cylinder to a central (neutral) position blocking both outlets. In each toggle position, the respective inlet remains unobstructed so that the air pressure from the main tube 81 can be carried by interconnecting tubing 101 to the other pneumatic switches in the sequence. Each outlet of each pneumatic toggle switch 28–31 is coupled to the inlet of a respective pneumatic pressure switch via individual secondary tubes of essentially non-electrically conducting material such as plastic, for example vinyl, in tube assembly 18. Pneumatic throttle toggle switch 33 has only its outlet 92 coupled to the inlet of a pneumatic pressure switch (36) via a non-conducting secondary tube, output 97 being unconnected.

Operation of the toggle of a respective pneumatic toggle switch 28–31 and 33 communicates the main air tube 81 with the inlet to a particular pneumatic pressure switch via a particular secondary tube in tube assembly 18. The introduction of air pressure into a normally open pneumatic pressure switch causes the contacts of the switch to go from normally open to closed and thereby transmit current through the switch. The current is then coupled to the coil of the respective hydraulic valve via the electrical cable assembly 49, terminal block 75 and electrical cable assembly 51, completing the circuit from the battery through a respective coil to energize it. Thus, by operation of the respective toggle of a pneumatic toggle switch to one of its active positions, which are to the side of the central inactive position, the operator may divert air pressure to either of two active ports and from there via secondary tubing within tube assembly 18 to one of the normally open pneumatic pressure switches to cause it to close and thereby operate the associated hydraulic function.

Also within the remote controle panel assembly 16 is the two position pneumatic pressure emergency switch 32, also of conventional construction, which receives pressurized air from the main tube 81 via the interconnecting tubing 101. In its closed position, pneumatic toggle emergency switch 32 terminates the flow of pressurized air from the main tube 81 to the secondary tube 103 connected to the inlet of the pneumatic pressure switch 45. Thus by operation of the toggle of pneumatic emergency switch 32 to its active (non-closed) position, air pressure can be blocked from the secondary tube 103 so that air pressure no longer reaches the normally closed pneumatic pressure switch 45. This causes pressure switch 45 to return to its closed position and thereby act upon the solenoid of the emergency dump valve to shut down the hydraulic functions of the machine in an emergency.

The secondary tubes from the active ports of each of the three position toggle switches 28–31 and 33 in the pneumatic control panel assembly extend within the tube assembly 18 to the inlet port of a respective quick exhaust shuttle valve 105 in converter assembly 47, and the secondary tube 103 from the active port of the two position pneumatic switch 32 in the pneumatic control panel assembly extends within the tube assembly 18 to the inlet port of a shuttle valve 107.

The shuttle valves 105 and 107 and the pneumatic pressure switches (FIG. 5) are supported in a solid block or plate 109 of suitable material such as plastic. The shuttle valves are disposed with their inlet ports on one side of the block so that the individual secondary tubes from the pneumatic toggle switches can be connected thereto, and with their outlet ports in communication with respective through holes 111 in the block.

The inlets of the pneumatic pressure switches are in communication with the through holes so as to be in communication with the outlet ports of the shuttle valves. Thus, air pressure introduced into the shuttle valves from the active ports of the pneumatic pressure switches can be communicated to the inlet of the respective pneumatic pressure switch.

Figure 8:
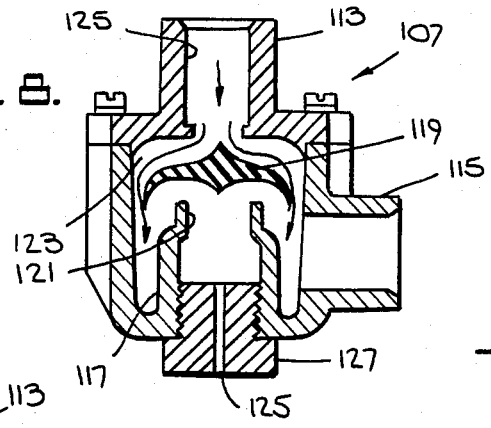
FIGS. 8–10 are sectional views of a pneumatic shuttle valve connected to the emergency pneumatic pressure switch in the converter assembly of FIG. 5 depicting the valve in different operating conditions thereof.
Figure 9:
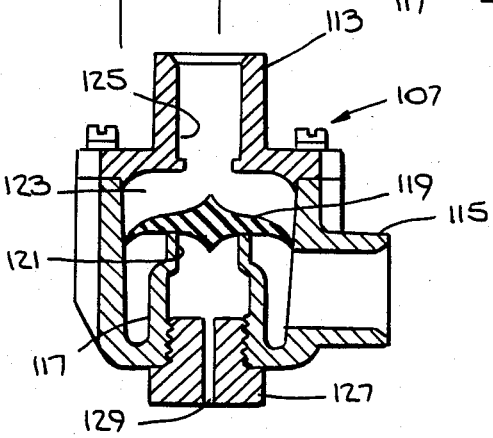
Figure 10:
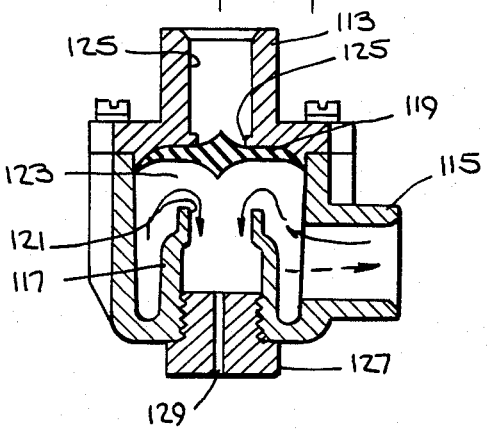

The shuttle valve 107 to emergency pneumatic pressure switch 45 is depicted in FIGS. 8–10 and includes an inlet port 113 to which an end of the secondary tube 103 from the outlet port of the two position (emergency) pneumatic toggle switch 32 is connected, an outlet port 115 connected to the inlet of the emergency pneumatic pressure switch 45 via the through hole 111 in plate 104, and an exhaust port 117. In the position shown in FIG. 8, pressurized air has been introduced into the valve inlet port and causes the valve sealing member 119 to move to and be seated at the valve seat 121 to the exhaust port. The periphery of the sealing member is flexed away from the internal surface of the valve chamber 123 to thereby communicate the valve inlet port with the valve outlet port while sealing the exhaust port.

In FIG. 9, a static position is illustrated in which no pressurized air is introduced into the valve inlet port as controlled by the pneumatic toggle switch 32 and no residual air pressure is present at the inlet of the pressure switch 45. This causes the sealing member 119 to remain seated on the exhaust valve seat 121. In this valve position, the valve inlet port is sealed from the valve outlet port while the exhaust port remains sealed.

In FIG. 10, air pressure is not actively being introduced into the valve inlet port while there is residual air pressure at the inlet of the pressure switch 45. This can indicate that emergency switch 32 is in a blocking position or that pinching or crimping of tube 103 or of a tube in the supply line to emergency toggle switch 32 so as to block the introduction of pressurized air into the valve. The sealing member in this situation moves to a position in which it is seated on the inlet valve seat 125 and communicates the valve outlet port with the exhaust port to allow the residual pressurized air in the valve chamber to vent and cause the pneumatic pressure switch 45 to switch states. The exhaust port 117 is closed by a plug 127 having a small diameter through hole 129 to permit residual pressurized air to bleed off in the valve position of FIG. 10 in a reasonably short time in the order of from about 1 to about 2 seconds. This provides a time delay before the pressure switch 45 can switch to energize the emergency dump valve and prevents switching of the pressure switch in response to insignificant blockages.

The shuttle valves 105 are conventional valves and are similar to the shuttle valve 107 but do not include the plug 127 in the exhaust port. Hence, the exhaust port is a quick exhaust port and the valve is a conventional quick exhaust shuttle valve. Each quick exhaust shuttle valve will be in the position of FIG. 10 when a respective pneumatic function toggle switch is in its central position or if a blockage occurs in a respective secondary tube. This allows the pressure in the valves to vent quickly and causes the respective pressure switch to switch. Thus, if a blockage occurs in a secondary tube to any of pressure switches 36–44, only the respective crane function is closed down.

The main tube and secondary tubes are preferably bunched together tightly within the tube assembly 18 in order to provide mechanical support for each other and thereby to help avoid crimping or pinching of individual tubes. The tubing assembly is further enclosed by a sheath 131 which holds the bunched cables together and adds to the mechanical strength and stability of the tube assembly. The sheath is preferably made of a vinyl material, but in any event is as substantially electrically non-conductive as the tubing so that no conductive path lies between the crane or truck and the pneumatic control panel assembly. The sheath of the tubing assembly is preferably of a tough material which is less subject to elongation under tension than the tubes within it and is connected between strain relief clamps 133 and 135 on the converter assembly 47 and the pneumatic control panel assembly 16, respectively, thereby eliminating strain on the internal tubing. The sheath is also water impermeable to prevent the intrusion of water which could form conductive paths within the tube assembly.

The sheath according to a preferred embodiment is heat shrinkable tubing (shrink tubing) or extruded sheathing. The use of shrink tubing enables the sheath to be drawn tightly about the individual tubes to tightly bunch them together and allows the sheath to conform exactly to the outer surface configuration of the bunched tubes. This eliminates voids between the sheath and the individual tubes and between individual tubes, thereby preventing the possibility that conductive paths can be formed between the sheath and individual tubes and between individual tubes.

To further reduce the possibility of a conductive path from the converter assembly 47 to the pneumatic control panel assembly 16, the latter is made of a non-metallic material such as vinyl plastic.

The apparatus described above in addition to providing a substantially electrically non-conducting connection between a remote control assembly and the crane being operated also solves the problem of runaway operation should the tube assembly connecting the remote control assembly to the crane accidently become crimped or pinched. When the pneumatic portion of the control system is started up to permit remote control of the crane, air under sufficient pressure from the air tank 57 passes through the control valve 59 and the filter 63 to the converter assembly 47 where it enters the regulator 77 which has been set so that the pressure available at the output of the regulator is at a suitable operating pressure. From the regulator, pressurized air is made available to the toggle switches at the pneumatic control panel assembly 16 via the main tube 101 in the tube assembly 18.

When the two position emergency toggle switch 32 is in the on position, air pressure is available via the secondary tube 103 at the normally closed pneumatic pressure switch 45 to open that switch, thereby activating the solenoid circuit which permits the emergency dump valve to open and transmit hydraulic pressure to the crane hydraulic valves. Thus, the crane hydraulic system is only activated when adequate air pressure is available at the pressure switch 45 via the pneumatic control panel assembly.

In the event that the tube assembly 18 becomes crimped or pinched so that air cannot flow between the pneumatic control panel assembly and the converter assembly, and one or more toggle switches in the pneumatic control thus becomes inoperative to control its associated functions, a "runaway" condition could result. If the emergency switch 32 is operative, then operation of that switch would shut down the hydraulic system as described above and halt the runaway condition. However, should either the air supply to the emergency toggle switch 32 become blocked or the secondary tube 103 to the emergency pneumatic switch 45 become blocked so as to prevent operation of that switch by the two position emergency toggle switch 32, then there would be no way to halt the runaway condition while the operator is at a location remote from the electrical control panel assembly of the crane. The invention allows air pressure to bleed from the emergency pneumatic pressure switch 45 when the supply of air to emergency toggle switch 32 is blocked or the secondary tube 103 is blocked, as described above. When sufficient air pressure has been bled off, pressure switch 45 switches to shut down the crane hydraulic system. As mentioned, the hole diameter of the plug is selected to permit the pressure at the inlet port to the pressure switch 45 to drop within a reasonable time, but does not provide so much leakage that during normal operation the normally closed pressure switch is activated unintentionally. An appropriate diameter for the bore of the plug is approximately from about 0.006 inch to about 0.013 inch, although other appropriate values may easily be determined to be effective by simple trial and error, given different components and pressure ranges.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. A control apparatus for a machine having plurality of electrically-operated machine functions comprising:

a plurality of normally-open electrical pressure switches each adapted to be activated by air pressure at an inlet thereof;

a normally closed electrical pressure switch adapted to be activated by air pressure at an inlet thereof;

a plurality of pneumatic switches connected in sequence to receive pressurized air through a substantially non-electrically conducting main tube from a source of pressurized air;

each pneumatic switch including an inlet connected in sequence to said main tube and at least one outlet and adapted to communicate the switch inlet with a switch outlet upon actuation of the valve;

a plurality of substantially electrically non-conducting secondary tubes each adapted to transmit air pressure from an outlet of said pneumatic switches to an inlet of one of said normally open pressure switches;

a pneumatic valve having an inlet port, an outlet port and an exhaust port, said outlet port being connected to the inlet of said normally-closed pressure switch and said exhaust port venting air pressure at the inlet of said normally-closed pressure switch in response to a reduction in air pressure at said inlet port of the valve;

a further substantially electrically-non-conducting secondary tube adapted to transmit air pressure from one of said pneumatic switches to the inlet port of said valve;

a plurality of electric switches connected in parallel with a corresponding pressure switch for operating respective one of the plurality of electrically operated function valves; and an electric switch connected in parallel to said normally closed electrical pressure switch, wherein operation of said electric switch dumps hydraulic pressure from the apparatus.

2. The control apparatus according to claim 1 and comprising a means for venting air pressure slowly from said exhaust port so as to introduce a time delay between said reduction in air pressure at said inlet port of said valve and the venting of a substantial part of the air pressure at the inlet to the normally-closed pressure switch.

3. The control apparatus according to claim 2 wherein said means for slowly venting air pressure comprises a plug having a restricted opening which is received in said exhaust port.

4. The control apparatus according to claim 1 or 2 and comprising a plurality of quick exhaust pneumatic valves each having an inlet port, an outlet port and an exhaust port, the inlet port of each valve being connected to one of the plurality of secondary tubes, the outlet port of each valve being connected to the inlet of a respective a normally-open pressure switch, said exhaust port of each valve being adapted to vent substantially all of the air pressure at the inlet to a respective pressure switch in response to a reduction in air pressure at the inlet port of the respective valve.

5. A control apparatus for a machine having a plurality of machine functions operated hydraulically from pressure derived from a hydraulic line comprising:

(a) a source of pressurized air;

(b) a pneumatic to electric converter assembly comprising:

a plurality of normally open electrical pressure switches each adapted to be activated by air pressure at an inlet thereof, and a normally closed electrical pressure switch adapted to be activated by air pressure at an inlet thereof;

(c) a remote control apparatus comprising:

a plurality of three position pneumatic switches connected in sequence to receive pressurized air from said air source via a main tube, each pneumatic switch having an inlet and two active outlets, actuation of any of said three position pneumatic switches into a first or second active position causing pressurized air to be provided at a corresponding first or second outlet port of said three position pneumatic switch, and a two position pneumatic switch having an inlet and an outlet connected in said sequence to receive pressurized air at its inlet;

(d) a pneumatic valve having an inlet port, an outlet port and an exhaust port, said outlet port being connected to the inlet of said normally-closed pressure switch and said exhaust port venting air pressure at the inlet of said normally closed pressure switch in response to a reduction in air pressure at said inlet port of said valve;

(e) a tube assembly extending between said converter assembly and said remote control apparatus, said tube assembly comprising:

(i) said main tube which is essentialy electrically non-conducting, (ii) a plurality of essentially electrically non-conducting secondary tubes for transmitting air pressure from a respective outlet of said pneumatic switches to an inlet of respective pressure switches, and (iii) an additional essentially electrically non-conducting secondary tube for transmitting air pressure from the outlet of said two position pneumatic switch to the inlet of said normally-closed electrical pressure switch;

(f) an electrical switch apparatus comprising:

(i) a plurality of electric switches connected in parallel with corresponding pressure switches and coupled to respective electrically operated function valves, (ii) an electric switch connected in parallel with said normally-closed pressure switch and coupled so that operation of said electric switch dumps the pressure from the main hydraulic line.

6. The control apparatus according to claim 5 and comprising a means for venting air pressure slowly from said exhaust port so as to introduce a time delay between said reduction of air pressure at said inlet port of said valve and the venting of a substantial part of the air pressure at the inlet of the normally-closed pressure switch.

7. The control apparatus according to claim 6 wherein said means for slowly venting air pressure comprises a plug having a restricted opening which is received in said exhaust port.

8. The control apparatus according to claim 6 or 7 and comprising a plurality of quick exhaust pneumatic valves each having an inlet port, an outlet port and an exhaust port, the inlet port of each valve being connected to one of the plurality of secondary tubes, the outlet port of each valve being connected to the inlet of a respective a normally-open pressure switch, said exhaust port of each valve being adapted to vent substantially all of the air pressure at the inlet of a respective pressure switch in response to a reduction in air pressure at the inlet port of the respective valve.

* * * * *